United States Patent [19]

Mahoney et al.

[11] 3,955,500

[45] May 11, 1976

[54] TYPE BAND IDLER PULLEY MECHANISM

[75] Inventors: Frank A. Mahoney, Wyncote; Raymond J. Fonte, Conshohocken, both of Pa.

[73] Assignee: Sperry Rand Corporation, New York, N.Y.

[22] Filed: Feb. 5, 1975

[21] Appl. No.: 547,422

[52] U.S. Cl. ..... 101/111; 101/93.14

[51] Int. Cl.[2] ..... B41J 1/20

[58] Field of Search ..... 101/111, 122, 93.14; 74/242.12, 242.13 R, 242.13 A, 242.14 R

[56] References Cited

UNITED STATES PATENTS

| | | | |
|---|---|---|---|
| 3,007,344 | 11/1961 | Schaefer | 72/242.13 A |
| 3,113,467 | 12/1963 | McKenna | 72/242.14 R |
| 3,362,325 | 1/1968 | Foster | 101/122 |
| 3,805,697 | 4/1974 | Mahe | 101/111 |
| 3,805,698 | 4/1974 | Bowers et al. | 101/111 |
| 3,853,018 | 12/1974 | Folkert | 72/242.13 A |

*Primary Examiner*—Edgar S. Burr
*Assistant Examiner*—Edward M. Coven
*Attorney, Agent, or Firm*—William E. Cleaver

[57] ABSTRACT

An impact printer having an endless metallic type band is described. The print band is rotated about a drive pulley and an idler pulley contained within a print station cartridge casting. The adjustable idler pulley mechanism is mounted in the cartridge casting to permit different length print bands to be used with the cartridge. An arrangement of compression springs are associated with the idler pulley mechanism so as to apply a predetermined tensioning force on the band. Bands may be interchanged easily by collapsing the compression springs with finger pressure.

2 Claims, 5 Drawing Figures

TYPE BAND IDLER PULLEY MECHANISM

BACKGROUND OF THE INVENTION

1. Field of the Invention

This invention relates to an impact printer and more particularly to a band type impact printer wherein the print band is contained within a replaceable cartridge.

2. Description of the Prior Art

One type of high speed printer apparatus involves the use of an endless type band or carrier having raised characters and timing marks on one side which is used for printing information onto a record medium. The type band is carried by a pair of pulleys, one of which is a drive pulley and the other of which is a driven, or idler, pulley. The drive pulley, during rotation, causes the print band to scan along a print line of a record medium. A plurality of print hammers are arranged at uniformly spaced print positions along the print line over which the type band travels. The actuation of any of the print hammers drives a record medium against the type band to thereby cause printing. The impacting of the record medium against the type faces by the print hammers occurs at predetermined times depending upon the time when a character desired to be printed is at a predetermined columnar location. This type of impact printer is a line printer which will print a line of information and then will cause the record medium to be advanced to a new line position, whereupon a new line of data will be printed, and the process is repeated.

The type band used in such a printer may consist of an endless metallic type band having raised characters along a first lineal circumferential portion of the band, and timing marks along another lineal circumferential portion of the band. One such printer is sold by Nortec Computer Devices Inc. as a Nortec 200 line printer, and now believed sold by IOMEC Corporation. Known prior art patents made of record in this application are U.S. Pat. Nos. 3,224,366, 3,362,325, 3,805,697. Also made of record are U.S. pat. application Ser. Nos. 453,224 and 453,473 filed Mar. 21, 1974, Jan F. Wenstrup, inventor, and assigned to the assignee of this invention.

The endless metallic type band has advantages over either the slug type mechanisms used in chain type printers, or the flexible bands which use flexible finger type elements. For example, the chain printer which uses slugs has type slugs which may be individually secured to a continuous carrier. The drawbacks of such slug type devices include frequent maintenance and replacement of parts and high manufacturing costs. On the other hand, endless metallic band printers have a number of desirable features. For example, different length bands or bands with different type fonts or character styles may be quickly installed on the printer. Such installation is facilitated by the present invention where the band is supported in a replaceable cartridge on a pair of pulleys. One of the pulleys is spring loaded and operates to hold the band on the pulleys under a predetermined amount of tension. In addition, the idler pulley is arranged to be adjustably spaced from the drive pulley so that different length bands may be employed.

SUMMARY OF INVENTION

The present invention discloses an impact printer which includes a replaceable print cartridge element.

The cartridge element includes a replaceable endless print band; a drive pulley, and an idler pulley. The print band is supported within the cartridge element by the above-mentioned pulleys which in turn are rotatably journaled within the cartridge. A print band drive motor mounted on the main frame of the printer is coupled to the drive pulley via a detachable coupling element.

The detachable coupling element permits the print cartridge including the drive and idler pulleys and the print band to be quickly and easily removed as a unit from the printer.

The idler pulley mechanism includes a pair of trolley rails secured to the cartridge and an idler pulley trolley is slidably mounted on the trolley rails. The idler pulley is rotatably journaled to the trolley. An adjustably positioned retaining ring is mounted on each of the trolley rails and an individual compression spring is inserted between each of the retaining rings and the adjacent side of the trolley. The position of retaining rings along the trolley rails can be varied so that the spacing between the idler pulley and drive pulley can be adjusted to accommodate different length print bands. The compression springs act on the trolley to urge it away from the drive pulley so as to hold the print band on the pulleys under a predetermined amount of tension.

The invention easily allows a change of bands by manually collapsing the springs by moving the trolley toward the drive pulley, changing bands and releasing the trolley, permitting the springs to re-exert the force and tension on the band. Proper tension is maintained through the springs, on the band at all times.

The mechanism likewise easily accommodates different size bands. Only the location of the retaining rings in differently located notches on the trolley rails need be changed to provide for smaller or larger length type bands.

BRIEF DESCRIPTION OF THE DRAWINGS

The foregoing and other objects, features and advantages of the invention will become further apparent from the following description of the invention as illustrated in the accompanying drawing in which.

DESCRIPTION OF THE PREFERRED EMBODIMENT

Figure 1:
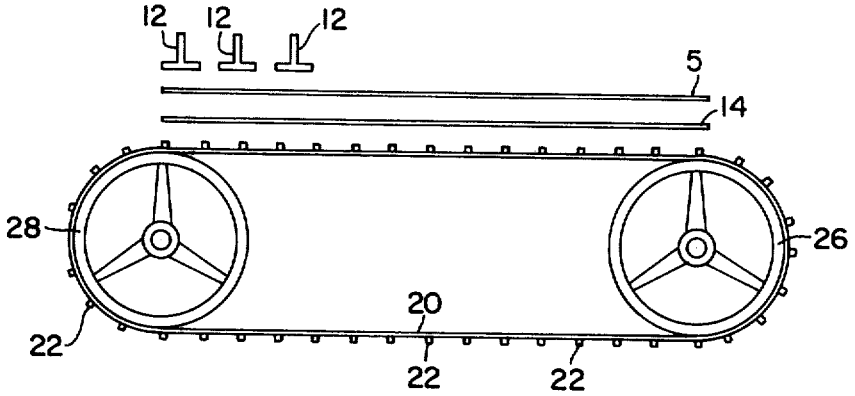
FIG. 1 is a schematic drawing showing the relationship between the type band and pulleys, and the inking ribbon, record medium and the print hammers.

Referring to the drawing, FIG. 1 schematically shows portions of the print station of an impact printer in which an endless metallic band or belt 20, formed preferably of magnetic material, is provided to be rotated about a drive pulley 26 and an idler or driven pulley 28. During printing the band 20 is continuously moved along a print line of print medium 5 by the pulleys 26 and 28. The drive motor (shown hereinafter), is connected over a pulley shaft to drive pulley 26, and causes the pulleys to be rotated in a well known manner, and the band 20 is correspondingly rotated about the pulleys.

Figure 2:
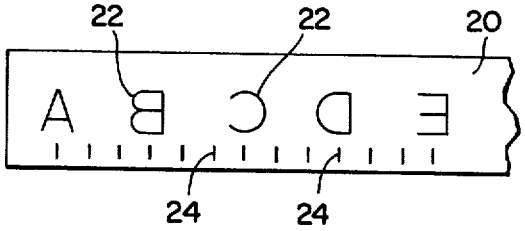
FIG. 2 is an enlarged plan view of the type band.

The general features of the type band are shown in FIG. 2. As shown therein, type band 20 may consist of an endless metallic band having formed thereon a plurality of different raised print characters 22. Disposed along another path on band 20 are a plurality of raised timing marks 24 which are used to fire the print hammers 12 in a well known manner. The band 20 may include several complete character fonts successively disposed about the length of the band.

As further shown in FIG. 1, the print station additionally includes a set of print hammers 12, generally one print hammer for each print column and an inking ribbon 14. As the band 20 is displaced along a predetermined path past the array of print hammers 12, a character may be printed in a predetermined column of a line by energizing the hammer at the predetermined column and causing medium 5 to impact the particular character 22 to be printed from band 20 through the inking ribbon 14. THe ribbon 14 may be fed across the record medium 5 between conventional means such as a pair of rotatable spools (not shown) and the paper record medium 5 is fed upwardly in a step-like manner a line at a time each time a complete line of data is printed on medium 5.

Figure 4:
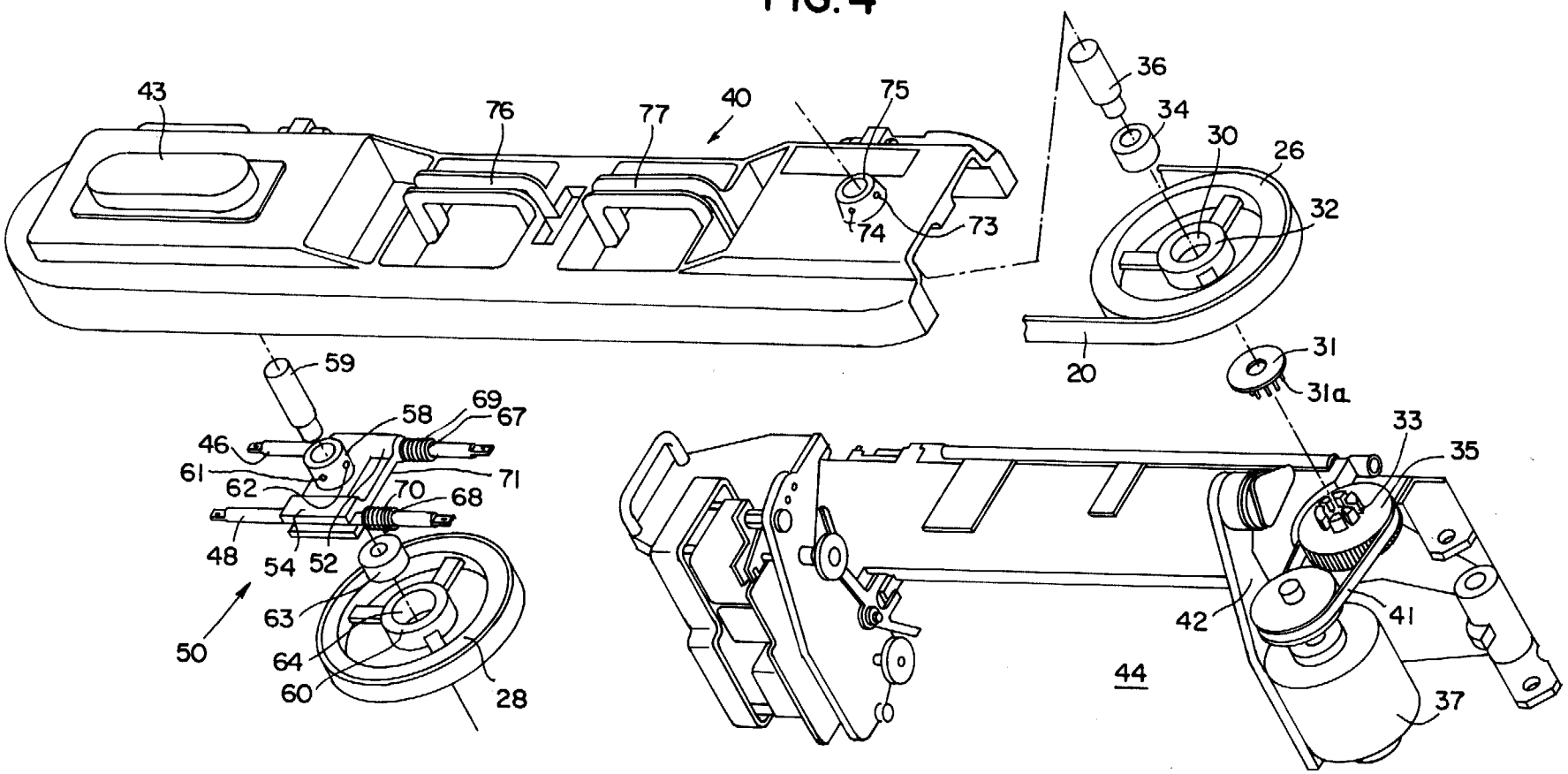
FIG. 4 is an exploded isometic view of the print station cartridge showing the idler pulley mechanism.

As is generally depicted in FIG. 4, some of the elements of the print station, and in particular those associated with moving and interchanging the type band 20, are enclosed within a one-piece cartridge casting generally referenced by numeral 40. Among those mechanisms enclosed within cartridge 40 are the drive pulley 26, idler pulley 28, type band 20, and the idler pulley mechanism generally identified by numeral 50. The drive pulley 26 has a bore 30 within its inner hub 32 in which an annular ball bearing 34 is fitted. The ball bearing 34 rotatably couples the drive pulley 26 to a fixed stub shaft 36. Shaft 36 is in turn fixedly held by set-screws 73 and 74 in a bore 75 found in the cartridge 40.

A coupling element 31 having a series of fingers 31a is secured to the bottom of inner hub 32 of the drive pulley 26. The finger element 31*a* removably engages a similar set of fingers 33 formed in a drive pulley 35. Drive pulley 35 is belt driven by a belt 41 and drive motor 37. Motor 37 is fixed to the side plate 42 of the main frame 44 of the printer.

The cartridge 40 is, as illustrated, a one piece casting which is dropped over the print station of the printer so that the drive pulley 26 is coupled to the print band drive motor 37 via the detachable coupling element 31 and 33. Mounting pins or the like which are not shown may be used to center the cartridge 40 on the main frame 44 of the printer, while the handle members 76 and 77 may be used by the operator to load and unload the cartridge 40 from the printer. A protective cap 43 acts as a safety cap and access area for the idler pulley mechanism.

Figure 3A:
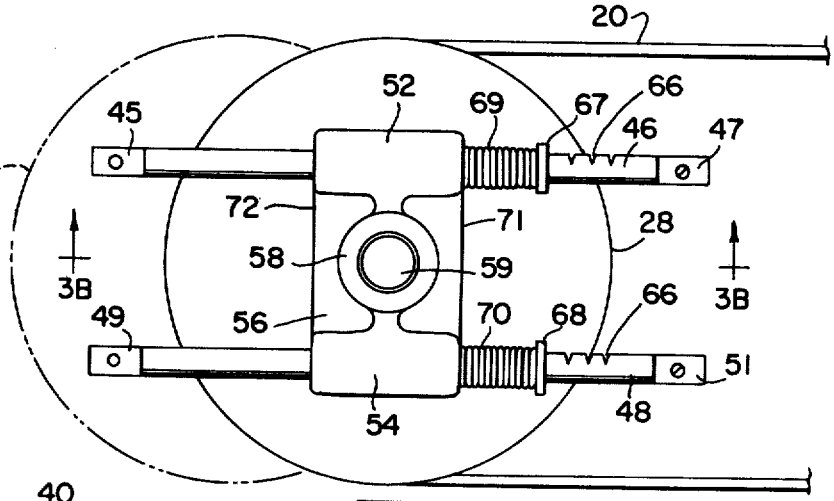
FIGS. 3A and 3B are top and side views of the idler pulley mechanism.
Figure 3B:
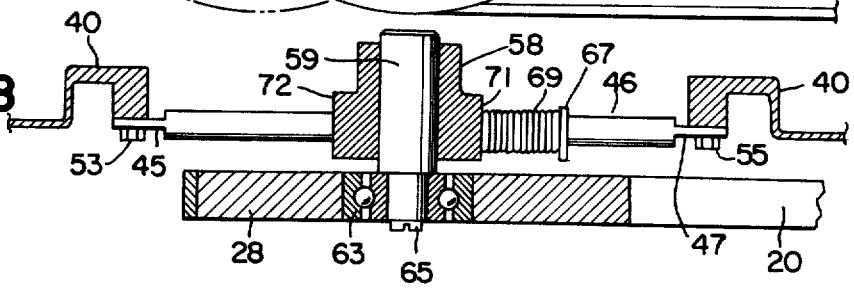

Referring now to FIGS. 3A and 3B, as well as FIG. 4, it can be seen that the idler pulley mechanism includes a pair of trolley type rails 46 and 48, which have at their end portions respective apertured flats 45 and 47, and 49 and 51. Each of the flats 45, 47, 49 and 51 on the rails mates with a corresponding flat on the underside of the cartridge casting 40 which acts as a support means for the trolley rails (FIG. 3B). Each flat is screwed into the cartridge casting 40 so that the rails are aligned in parallel along the length of the cartridge. For example, rail 46 is shown in FIG. 3B secured to the underside of cartridge 40 by screws 53 and 55.

A trolley or idler pulley casting block 56 (FIG. 3A) is configured so as to be slidably mounted on rails 46 and 48. In order to eliminate tight tolerances and to facilitate placement and movement of trolley 56 on rails 46 and 48, one aperture in the trolley, namely the aperture located within slider 52 is circular, while the other aperture in the trolley, namely the aperture located within slider 54 is C shaped (FIG. 4). The trolley 56 contains a centrally located collar section 58 through which the stub shaft 59 of the idler pulley 28 extends. Shaft 59 is secured to the collar 58 by set screws 61 and 62. Loosening the set screws 61 and 62 permits the shaft 59 to be moved up and down in the collar 58 and thereby permits the idler pulley 28 to be vertically aligned with the drive pulley 26.

Like the drive pulley 26, the idler pulley 28 also has a bore 64 within the pulley inner hub 60, in which a ball bearing 63 is located. A retaining screw 65 (FIG. 3B) is threaded into idler pulley shaft 59 clamping the inner race of bearing 63 and preventing shaft 59 from coming out of bearing 63. It is noted that the idler pulley 28 is freely rotated without being coupled to the drive motor 37 in any way other than through the type band 20.

The idler pulley mechanism 50 also includes compression means for maintaining a predetermined tensioning force on type band 20. Each trolley rail 46 and 48 has located thereon a plurality of spaced slots 66 (FIG. 3A) into which a snap ring such as ring 67 on rail 46 and snap ring 68 on rail 48 may be inserted. A retaining ring is a C shaped device that is "shut" by its own spring tension. It is spread open and slipped over the shaft into the grooves 66 where it snaps shut. In the preferred embodiment the retaining rings that are employed are manufactured by the Waldes Kohinoor, Inc. of Long Island, N.Y. but it should be understood that other retaining rings may be employed. Likewise each rail has an individual compression spring such as springs 69 and 70 placed about the rail and retained between the respective snap rings 67 and 68 and side wall 71 of trolley 56. The springs 69 and 70 exert pressure on the trolley and hence through the pulley 28 on type band 20 keeping the proper tension on the band.

The idler pulley mechanism 50 also provides for accommodation of different length type bands. A shorter band is accommodated by moving each snap ring 67 and 68 to a notch 66 to the right of the setting shown in the drawing, and vice versa a longer band is accommodated by moving each retaining ring to a notch 66 to the left of the setting shown in the drawing.

To change type bands, cartridge 40 is removed from carriage 44 and manual pressure is exerted against outer side wall 72 of trolley 56, causing compression springs 69 and 70 to collapse and allowing type band 20 to fall free of the idler and drive pulleys. A new band is placed over the pulleys and when the trolley is released, the band is tensioned against the pulleys for rotation.

Although not shown it will be understood that the back of the cartridge 40 is configured to expose the print band 20 to the print hammers 12 when the cartridge 40 is installed on the main frame 44 of the printer. For example, an elongated window area may be formed in the back of the cartridge through which the print hammers 12 may pass in striking the print band 20. In the alternative, exit and entry slots may be formed in the back of the cartridge 40 to permit band 20 to move externally of the cartridge 40 as it passes the row of print hammers 12.

While the above detailed description describes our invention in conjunction with an impact printer, it should be readily recognized that the invention may be readily practiced with non-impact print bands such as electrostatic printing stencils etc.

We claim:

1. In a printer in which an endless type character band is driven about a drive pulley and about a freely rotating idler pulley by a drive motor, the improvement comprising: a detachable coupling connecting the drive motor and the drive pulley; a print station support means; first and second rail means secured to said support means, said first and second rail means each having a plurality of notches formed therein; an idler pulley trolley slideably mounted on said first and second rail means; first and second retaining ring means formed to fit into any one of said notches respectively of said first and second rail means and with said first retaining ring means disposed in a notch in said first rail means and said second retaining ring means disposed in a notch in said second rail means and with both said first and second retaining ring means disposed between said idler pulley trolley and said drive pulley; an idler pulley shaft carried by said trolley for mounting said idler pulley on said trolley, said idler pulley mounted on said idler pulley shaft to move in a vertical direction therewith; means for adjusting the vertical position of said idler pulley shaft on said trolley; spring compression means mounted on said first and second rail means and interposed between a side of said trolley and said first and second retaining ring means whereby said trolley is forced away from said retaining ring means to maintain a predetermined tensioning force on said type character band as said band is rotated about said pulleys and said plurality first retaining ring means being locateable in any one of said plurality of notches on said first rail means and said second retaining means being locateable in any one of said plurality of notches on said second rail means whereby a number of different sizes of type character bands can be held under tension as each is used with said printer.

2. The invention defined in claim 1 wherein said print station support means comprises a replaceable print station cartridge for housing said drive and idler pulleys.

* * * * *